US007402194B2

(12) United States Patent
Furukawa et al.

(10) Patent No.: US 7,402,194 B2
(45) Date of Patent: Jul. 22, 2008

(54) CARBON NANOTUBES AS LOW VOLTAGE FIELD EMISSION SOURCES FOR PARTICLE PRECIPITATORS

(75) Inventors: Toshiharu Furukawa, Essex Junction, VT (US); Mark C. Hakey, Fairfax, VT (US); Steven J. Holmes, Guilderland, NY (US); David V. Horak, Essex Junction, VT (US); Charles W. Koburger, III, Delmar, NY (US)

(73) Assignee: International Business Machines Corporation, Armonk, NY (US)

( * ) Notice: Subject to any disclaimer, the term of this patent is extended or adjusted under 35 U.S.C. 154(b) by 276 days.

(21) Appl. No.: 11/161,220

(22) Filed: Jul. 27, 2005

(65) Prior Publication Data

US 2007/0051237 A1 Mar. 8, 2007

(51) Int. Cl.
*B03C 3/60* (2006.01)

(52) U.S. Cl. ..... 95/59; 96/69; 96/95; 96/97; 96/98; 252/502

(58) Field of Classification Search ..... 96/69, 96/95–100; 95/59; 252/502; 361/225–235
See application file for complete search history.

(56) References Cited

U.S. PATENT DOCUMENTS

| | | | | | |
|---|---|---|---|---|---|
| 2,277,712 | A * | 3/1942 | Otto | 315/58 |
| 3,765,154 | A * | 10/1973 | Hardt et al. | 96/88 |
| 4,670,026 | A * | 6/1987 | Hoenig | 95/73 |
| 5,445,798 | A * | 8/1995 | Ikeda et al. | 422/121 |
| 5,476,539 | A * | 12/1995 | Suzuki et al. | 96/44 |
| 5,933,702 | A * | 8/1999 | Goswami | 422/186.3 |
| 5,993,738 | A * | 11/1999 | Goswani | 422/22 |
| 6,901,930 | B2 * | 6/2005 | Henley | 128/205.27 |
| 6,975,074 | B2 * | 12/2005 | Takeuchi et al. | 315/167 |
| 7,008,465 | B2 * | 3/2006 | Graham et al. | 95/78 |
| 7,063,820 | B2 * | 6/2006 | Goswami | 422/186.3 |
| 7,071,628 | B2 * | 7/2006 | Takeuchi et al. | 315/169.1 |
| 7,187,114 | B2 * | 3/2007 | Takeuchi et al. | 313/495 |
| 7,228,091 | B2 * | 6/2007 | Hays et al. | 399/168 |
| 7,288,881 | B2 * | 10/2007 | Takeuchi et al. | 313/399 |
| 2003/0136408 | A1 * | 7/2003 | Henley | 128/205.29 |
| 2004/0160726 | A1 * | 8/2004 | Lerche et al. | 361/233 |
| 2004/0251122 | A1 * | 12/2004 | Goswami | 204/157.3 |
| 2004/0255783 | A1 * | 12/2004 | Graham et al. | 96/69 |
| 2005/0233183 | A1 * | 10/2005 | Hampden-Smith et al. | 429/12 |
| 2006/0120944 | A1 * | 6/2006 | Petrik | 423/448 |
| 2006/0197018 | A1 * | 9/2006 | Chen | 250/326 |
| 2006/0280524 | A1 * | 12/2006 | Hays et al. | 399/168 |

FOREIGN PATENT DOCUMENTS

| | | | |
|---|---|---|---|
| JP | 53-130585 | * 11/1978 | 96/97 |
| JP | 5-154409 | * 6/1993 | 96/97 |

* cited by examiner

*Primary Examiner*—Richard L Chiesa
(74) *Attorney, Agent, or Firm*—Gibb & Rahman, LLC; Lisa U. Jacklitsch, Esq.

(57) ABSTRACT

An air particle precipitator and a method of air filtration include a housing unit; a first conductor in the housing unit; a second conductor in the housing unit; and a carbon nanotube grown on the second conductor. Preferably, the first conductor is positioned opposite to the second conductor. The air particle precipitator further includes an electric field source adapted to apply an electric field to the housing unit. Moreover, the carbon nanotube is adapted to ionize gas in the housing unit, wherein the ionized gas charges gas particulates located in the housing unit, and wherein the first conductor is adapted to trap the charged gas particulates. The air particle precipitator may further include a metal layer over the carbon nanotube.

5 Claims, 4 Drawing Sheets

CARBON NANOTUBES AS LOW VOLTAGE FIELD EMISSION SOURCES FOR PARTICLE PRECIPITATORS

BACKGROUND OF THE INVENTION

1. Field of the Invention

The embodiments of the invention generally relate to electrostatic air particulate filtration and, more particularly, to small scale electrostatic air particle filtration systems and devices.

2. Description of the Related Art

Filtering of air particle contaminants is important for areas such as microelectromechanical systems (MEMs), fuel cells, and other electronic devices. However, particulate filters tend to fill up with dirt and generally have to be replaced on a much too frequent basis and may require fans and motors to provide sufficient gas flow through the filter. Furthermore, particle precipitators have been widely used in the industry to gather particulates from gas streams on an industrial level.

However, one of the reasons that particle precipitators are not used on a small scale (for example, micro scale or nano scale) is the relatively high voltage that has to be applied to "charge" the air which then transfers the charge to the air borne particulates. Therefore, there remains a need for a novel air particulate filtration system capable of being used in small scale (for example, micro scale or nano scale) environments including MEMs applications.

SUMMARY OF THE INVENTION

In view of the foregoing, an embodiment of the invention provides an air particle precipitator comprising a housing unit; a first conductor in the housing unit; a second conductor in the housing unit (the first and second conductors comprise poles of an electrostatic field); and a carbon nanotube grown on the second conductor. Preferably, the first conductor is positioned opposite to the second conductor. The air particle precipitator further comprises an electric field source adapted to apply an electric field to the housing unit. Moreover, the carbon nanotube is adapted to ionize gas in the housing unit, wherein the ionized gas charges gas particulates located in the housing unit, and wherein the first conductor is adapted to trap the charged gas particulates. The air particle precipitator may further comprise a metal layer over the carbon nanotube.

Another aspect of the invention provides an electrostatic precipitator comprising a housing unit; (the collecting electrode and the field emission discharge electrode comprise poles of an electrostatic field) a collecting electrode in the housing unit; a field emission discharge electrode in the housing unit; and a carbon nanotube grown on the field emission discharge electrode, wherein the collecting electrode is preferably positioned opposite to the field emission discharge electrode. The electrostatic precipitator further comprises an electric field source adapted to apply an electric field to the housing unit. Furthermore, the carbon nanotube is adapted to ionize gas in the housing unit, wherein the ionized gas charges gas particulates located in the housing unit, and wherein the collecting electrode is adapted to trap the charged gas particulates. The electrostatic precipitator may further comprise a metal layer over the carbon nanotube.

Another embodiment of the invention provides a method of air filtration comprising positioning a first and second electrode in a housing unit (the first and second electrodes comprise poles of an electrostatic field); growing at least one carbon nanotube on the second electrode; and applying an electric field to the housing unit. The method further comprises positioning the first electrode opposite to the second electrode. Additionally, the method further comprises the at least one carbon nanotube ionizing gas in the housing unit; the ionized gas charging gas particulates located in the housing unit; and the first electrode trapping the charged gas particulates. Preferably, the method comprises growing a plurality of carbon nanotubes on the second electrode.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

The embodiments of the invention will be better understood from the following detailed description with reference to the drawings, in which.

DETAILED DESCRIPTION OF PREFERRED EMBODIMENTS OF THE INVENTION

Figure 1:
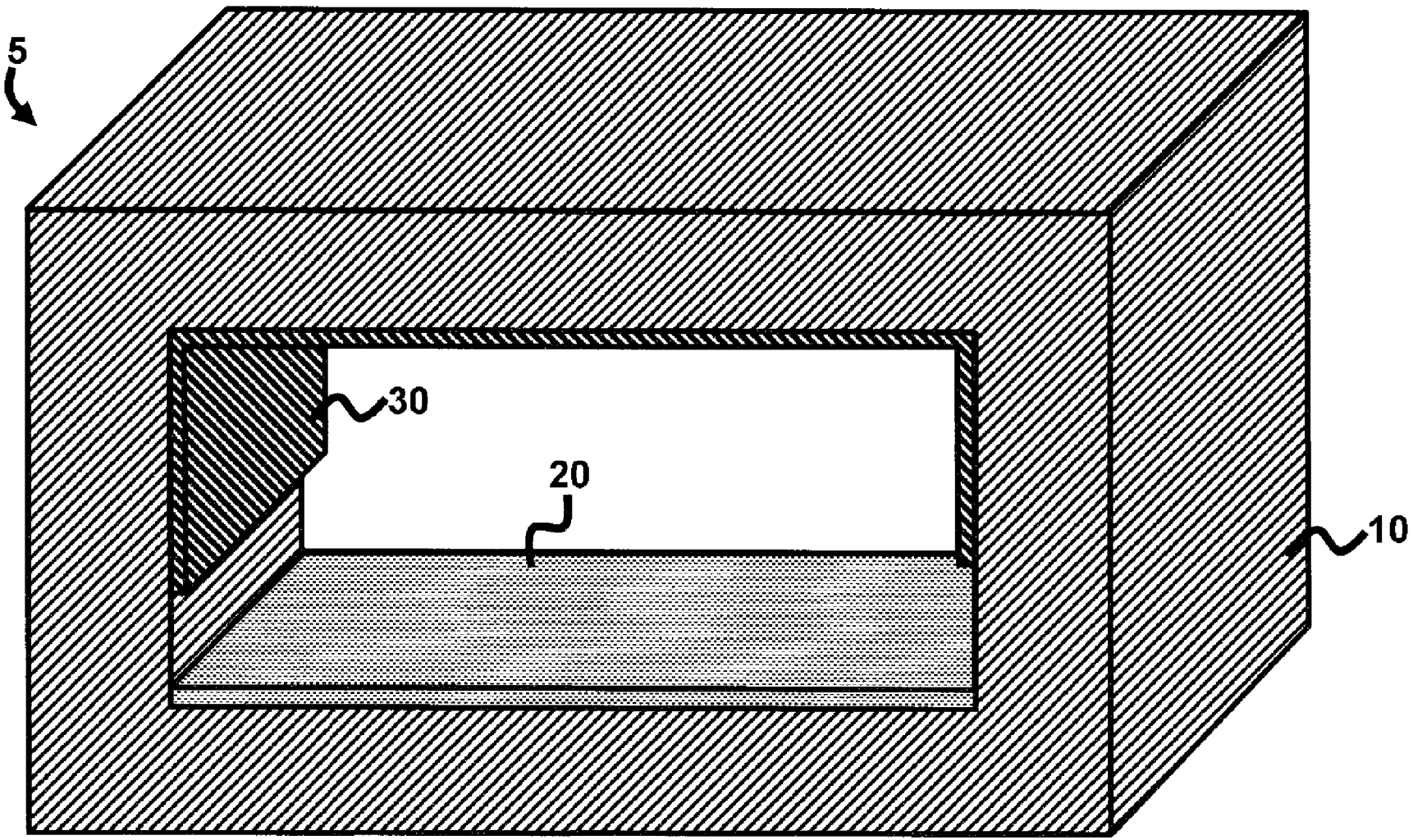
FIG. 1 illustrates a perspective view of a particulate air filtration system according to an embodiment of the invention.

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention.

As mentioned, there remains a need for a novel air particulate filtration system capable of being used in small scale (for example, micro scale or nano scale) environments. The embodiments of the invention achieve this by providing an electrostatic air particulate filtration system utilizing carbon nanotubes as field emission tips for air ionization leading to the particle charging and trapping. Therefore, by incorporating carbon nanotubes in the embodiments of the invention, a lower voltage level (compared to conventional electrostatic precipitators) is necessary to charge the gas to be filtered. Referring now to the drawings and more particularly to FIGS. 1 through 4 where similar reference characters denote corresponding features consistently throughout the figures, there are shown preferred embodiments of the invention.

Figure 2:
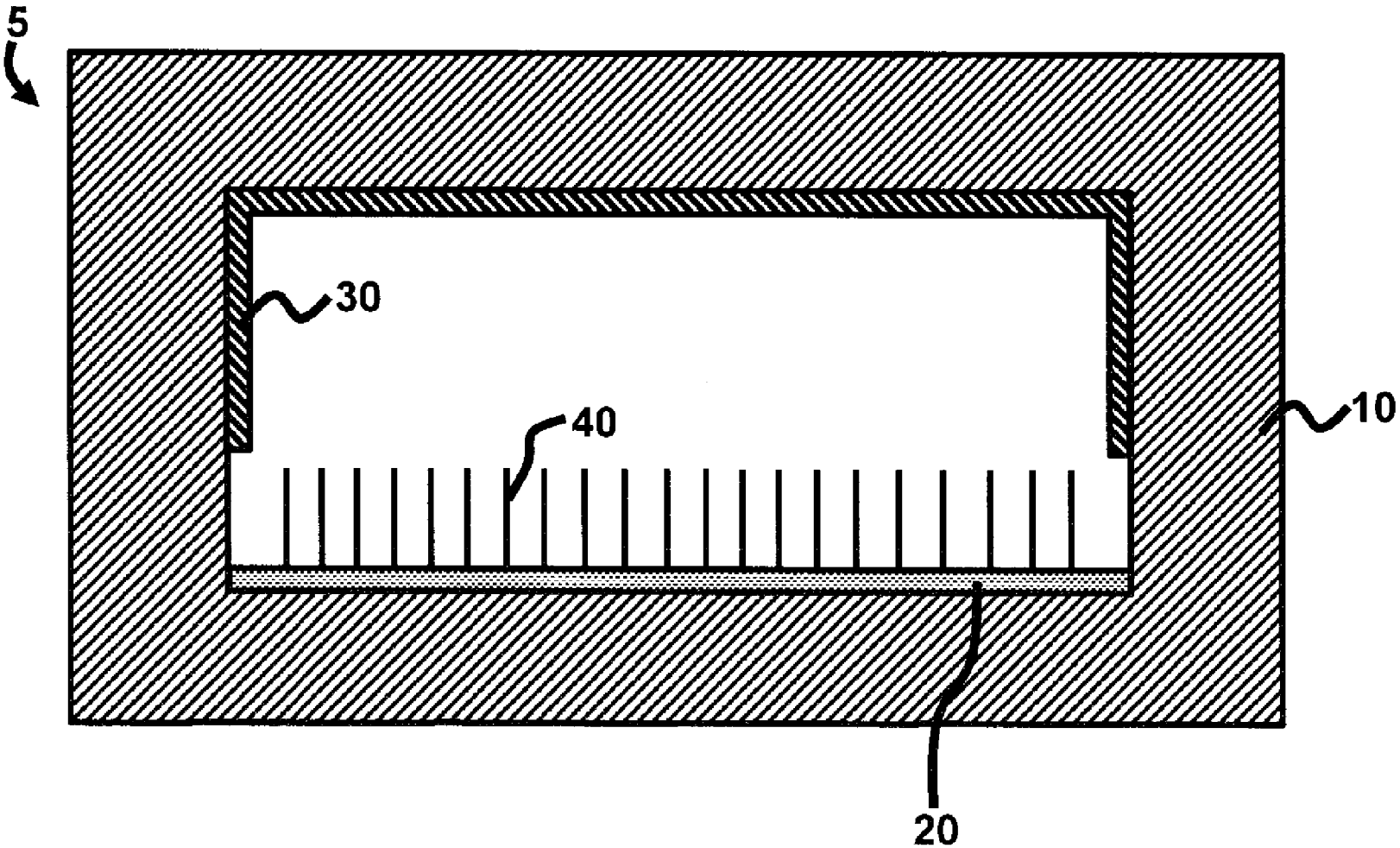
FIG. 2 illustrates a front view of a particulate air filtration system according to an embodiment of the invention.
Figure 3:
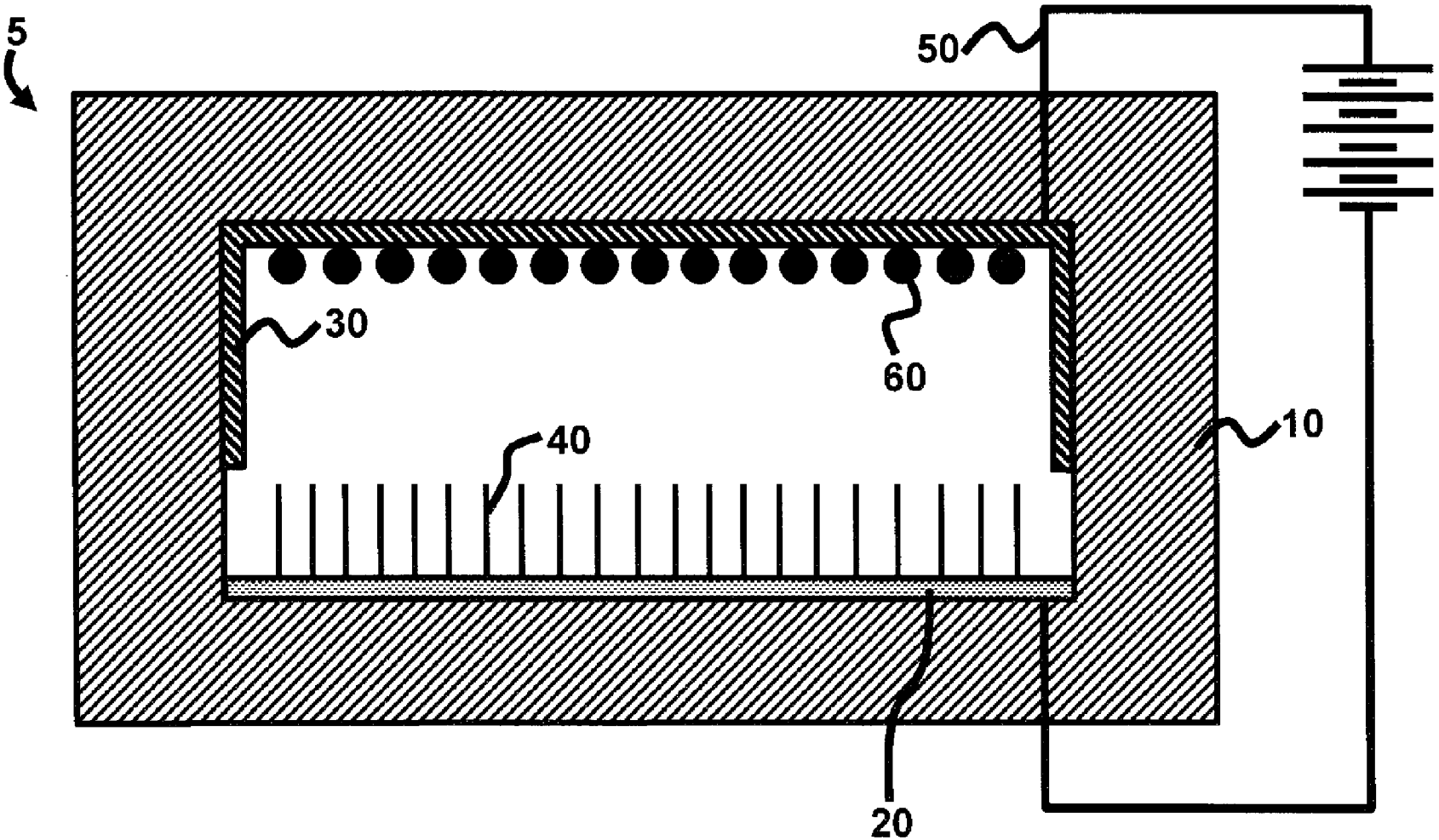
FIG. 3 illustrates a front view of a particulate air filtration system during operation according to an embodiment of the invention.

FIGS. 1 through 3 illustrates an electrostatic precipitator 5 comprising a housing unit 10; a carbon nanotube conductor (i.e., collecting electrode) 20 in the housing unit 10; a non-carbon nanotube conductor (i.e., field emission discharge electrode) 30 in the housing unit 10; and a carbon nanotube 40 (preferably a plurality of carbon nanotubes 40) grown on the carbon nanotube conductor 20, wherein the non-carbon nanotube conductor 30 is preferably positioned opposite to the carbon nanotube conductor 20. Preferably, the carbon nanotube conductor 20 is formed of materials that can support carbon nanotube growth. Examples of such materials include metals such as Co, Fe, Ni, or (or alloys of these materials with Mo). The oxides of Fe, Co and Ni can also be used as a catalyst, but these would be non-conductive, and it is desirable to have a conductive layer in this regard. Preferably, the non-carbon nanotube conductor 30 is formed of a metal that does not support carbon nanotube growth, and examples include Cu, Au, Ag, Pt, Pd, Al, and Zn. The carbon nanotubes 40 are formed of carbon and can be prepared by passing carbon containing gases over catalyst films (not shown) at temperatures of 600-900° C. Suitable gases include an acetylene/ammonia mixture, a carbon monoxide/hydrogen mixture, and a methane/ammonia mixture. Each of the conductors 20, 30 may be configured either as plates or wires or a mesh, depending on the desired application.

Preferably, the carbon nanotubes 40 are configured as single-walled carbon nanotubes having end diameters of less than 25 Å. However, multi-walled carbon nanotubes could also be used, wherein the multi-walled carbon nanotubes could have a diameter ranging from 5 nm to 200 nm. These multi-walled carbon nanotubes might be preferable for some applications as they could be more stable in chemically active environments. This allows the use of the electrostatic particle precipitator voltages to be maintained very low. The carbon nanotubes 40 function by being an efficient conductor, with a very narrow tip. When a voltage is applied to the conductors 20 and 30 the conductors 20, 30 comprise poles of an electrostatic field and, as shown in FIGS. 3, the electrons pass through the nanotubes 40 and out of the tip, spraying across the gap between the electrodes 20, 30 and ionizing gaseous species and particles that may be present in this gap. The charged particles are then attracted to the opposite electrode 30 and removed from the gas flow. The applied voltage could range from 1 V to 5000 V, depending on the width of the nanotube 40, the gas pressure, and the gap distance between the electrodes 20, 30. This might compare to 10,000 V to 60,000 V for conventional large scale industrial electrostatic particle precipitators.

Additionally, this relatively low voltage range (low compared to conventional large scale industrial electrostatic particle precipitators) allows the introduction of the electrostatic particle precipitator 5 provided by the embodiments of the invention to be used in a semiconductor fab, office, or a mobile environment. Specifically, the CNT electrostatic filter 5 might be used in fuel cells, portable chemical analysis tools, filtering the ambient for optical systems, filtering systems for computing devices such as hard drives, or MEMs. In addition, the carbon nanotubes 40 are extremely inert thereby damaging of the field emission carbon nanotubes 40 is highly unlikely. The stability of the carbon nanotubes 40 can be enhanced for some environments, if desired, by vapor deposition of metal films (not shown) such as gold, platinum, tungsten, palladium, copper, etc, onto the carbon nanotubes 40. This might be desired to protect the carbon nanotubes 40 from an oxidizing environment for some applications. Furthermore, the carbon nanotubes 40 can easily be grown on the filter surfaces in various geometries making the filter geometries highly configurable and inexpensive to make.

The electrostatic precipitator 5 further comprises an electric field source 50 adapted to apply an electric field to the housing unit 10. Furthermore, the carbon nanotube 40 is adapted to ionize gas in the housing unit 10, wherein the ionized gas charges gas particulates 60 located in the housing unit 10, and wherein the carbon nanotube conductor 20 is adapted to trap the charged gas particulates 60.

Figure 4:
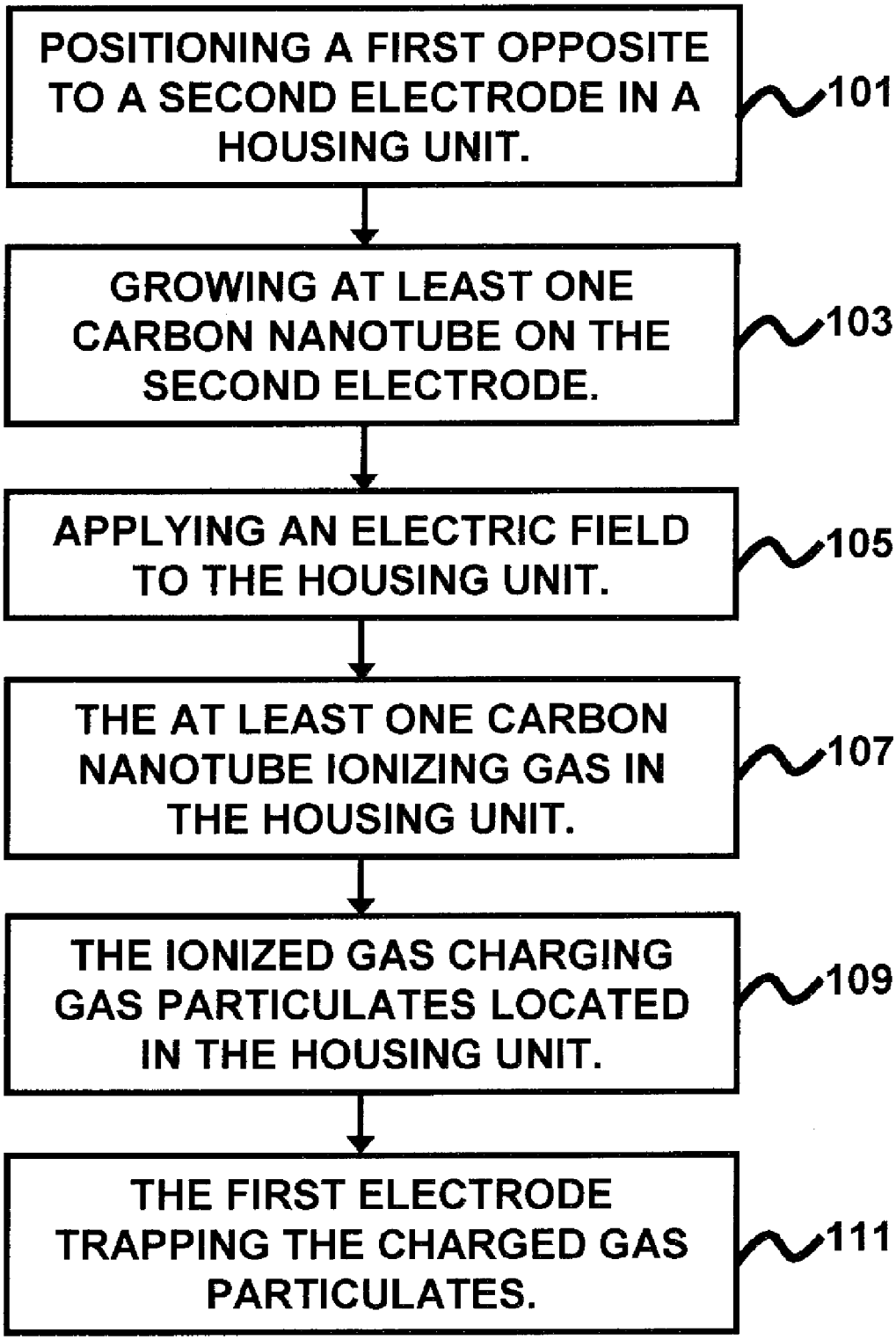
FIG. 4 is a flow diagram illustrating a preferred method according to an embodiment of the invention.

Another embodiment of the invention is illustrated in the flowchart of FIG.4, which include descriptions which refer to components provided in FIGS. 1 through 3. FIG. 4 illustrates a method of air filtration comprising positioning (101) a first electrode 20 opposite to a second electrode 30 in a housing unit 10; growing (103) at least one carbon nanotube 40 on the second electrode 30; and applying (105) an electric field to the housing unit 10. Additionally, the method further comprises the at least one carbon nanotube 40 ionizing (107) gas in the housing unit 10; the ionized gas charging (109) gas particulates 60 located in the housing unit 10; and the first electrode 20 trapping (111) the charged gas particulates 60. Moreover, the method preferably comprises growing a plurality of carbon nanotubes 40 on the second electrode 30.

The embodiments of the invention may be implemented in various applications. As an example, fuel cells use $O_2$ from the air to help produce electricity. Cleanliness of this air is important to maintaining the membrane, which will extend the lifetime of the device. The electrostatic precipitator 5 provided by the embodiments of the invention, on the other hand, can be easily cleaned and re-used either by removing the voltage and purging the electrostatic precipitator 5 with gas, or by re-cycling the filter housing 10 and removing the carbon nanotubes 40 with oxygen plasma or other appropriate means, and re-growing a fresh carbon nanotube structure in the filter housing 10. Moreover, the electrostatic precipitator 5 could be used to clean the air prior to entering a fuel cell. Additionally, because the carbon nanotubes 40 are small (approximately 30-200 nm in length and less than 10 nm in width), and electrostatic filters are generally used for large scale applications, such as smoke stack cleaning, electrostatic air particle precipitator 5 provided by the embodiments of the invention may be particularly useful for small devices such as MEMs.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the invention have been described in terms of preferred embodiments, those skilled in the art will recognize that the embodiments of the invention can be practiced with modification within the spirit and scope of the appended claims.

What is claimed is:

1. A method of electrostatically precipitating airborne particulates, said method comprising:

positioning a first electrode and a second electrode in a housing unit at a distance from one another, said first and second electrodes comprising poles of an electrostatic field;

growing at least one carbon nanotube on the second electrode, wherein said at least one carbon nanotube ionizes gas in said housing unit; and applying an electrostatic field between said first and said second electrodes.

2. The method of claim 1, further comprising positioning said first electrode opposite to said second electrode.

3. The method of claim 1, further comprising charging particulates by said gas, which is ionized, said charged particulates being located in said housing unit.

4. The method of claim 3, further comprising said first electrode being adapted to trapping the charged particulates.

5. The method of claim 1, further comprising growing a plurality of carbon nanotubes on the second electrode.

* * * * *